US005108470A

United States Patent [19]

Pick

[11] Patent Number: 5,108,470

[45] Date of Patent: Apr. 28, 1992

[54] CHARGING ELEMENT HAVING ODOUR AND GAS ABSORBING PROPERTIES FOR AN ELECTROSTATIC AIR FILTER

[76] Inventor: William Pick, Highway 15, R.R. #1, Carleton Place, Ontario, Canada, K7C 3P1

[21] Appl. No.: 610,944

[22] Filed: Nov. 9, 1990

Related U.S. Application Data

[63] Continuation of Ser. No. 351,168, May 12, 1989, abandoned.

[30] Foreign Application Priority Data

Nov. 1, 1988 [CA] Canada ..... 581883

[51] Int. Cl.[5] ..... B03C 3/00

[52] U.S. Cl. ..... 55/126; 55/131; 55/155

[58] Field of Search ..... 55/124, 126, 131, 155

[56] References Cited

U.S. PATENT DOCUMENTS 2,297,601 9/1942 Williams ..... 55/132
4,549,887 10/1985 Joannu ..... 55/131
4,886,526 12/1989 Joannu ..... 55/131
4,978,372 12/1990 Pick ..... 55/155

FOREIGN PATENT DOCUMENTS 2658510 6/1978 Fed. Rep. of Germany ..... 55/124
30400 3/1966 Japan ..... 55/124
162276 12/1979 Japan ..... 55/124

*Primary Examiner*—Bernard Nozick
*Attorney, Agent, or Firm*—Foley & Lardner

[57] ABSTRACT

A charging element having odour and gas adsorbing properties for use in electrostatic air filters of the charged media type is disclosed. The charging element improves the efficiency of such air filters and significantly broadens the range of pollutants removed from air filtered therethrough. The charging element comprises an electrically conductive, air pervious structure impregnated with an odour and gas absorbing agent, preferably activated charcoal. The charging element replaces any one or more of the traditional metallic charging elements in known electrostatic air filters of the charged media type.

15 Claims, 4 Drawing Sheets

CHARGING ELEMENT HAVING ODOUR AND GAS ABSORBING PROPERTIES FOR AN ELECTROSTATIC AIR FILTER

This application is a continuation of application Ser. No. 07/351,168, filed May 12, 1989 now abandoned.

The present invention relates to electrostatic air filters of the charged media type, and in particular to an improved electrostatic charging element having odour and gas absorbing properties for use in such air filters.

BACKGROUND OF THE INVENTION/ PRIOR ART

Electrostatic air filters of the charged media type are known in the art. Such filters are described in U.S. Pat. No. 4,549,887 and in the applicant's copending U.S. patent application Ser. No. 07/183,785. Electrostatic air filters of the charged media type may be generically described as having one or more dielectric fibrous filter pads sandwiched between opposing electrostatic charging elements and supported in an air handling system by a support frame. The fibres in the dielectric filter pads are polarized by an electrostatic field generated between opposing charging elements, one element being connected to a ground and the other element being connected to a high voltage, low amperage current supply. The electrical polarization of the filter fibres significantly enhances the removal of particulates from contaminated air. Fine dust, molds and other particles small enough to pass readily through uncharged fibre air filters, are successfully removed by electrostatic air filters of this type. Electrostatically charged media air filters remove air pollutants having diameters as small as 0.3 microns. Although electrostatic air filters of the charged media type represent a significant advance in the art of air filtration, these filters are not very efficient in removing odours or gases from filtered air. Odours and gases are molecular in structure and therefore too small to be efficiently removed from air filtered by prior art electrostatic air filters.

Carbon containing open celled foam sheet structures used for removing odours and gases in air handling and filtration systems, are widely available and known in the art. There are a variety of such filter constructions commonly available, being generally constructed from powdered carbon or activated charcoal in combination with a binding agent, frequently a plastic foam. Other constructions of odour and gas absorbing air filter structures are also commercially available. Any such structure is suitable for use as an electrostatic charging element for the purposes of the invention if it has the property of absorbing odours and gases from filtered air and is a conductor of electrical energy.

As stated above, electrostatic air filters of the charged media type include at least one dielectric fibrous filter pad sandwiched between a pair of opposing charging elements. Traditionally, metallic screen or mesh is employed as the charging elements in air filters of the charged media type. Although a metallic screen or mesh works efficiently as a charging element for dielectric fibrous filter pads, it does not contribute to the filtering capacity of an air filter. In accordance with the invention, a charging element is provided which not only serves to charge the dielectric filter pads of charged media type filters, but additionally absorbs odours and gases from the filtered air.

It has been further established that the present invention provides several unexpected advantages when employed as a charging element in an electrostatic air filter. Not only are odours and gases removed from the filtered air, the efficiency of an electrostatic air filter in accordance with the present invention is significantly enhanced in that more filtrates are removed from air than were removed by the prior art electrostatic filters described above. The carbon filled charging element also absorbs moisture from filtered air and, in extremely humid conditions, helps to keep the dielectric filter pads in a dry condition which enhances filter performance by inhibiting the leakage of electrostatic energy across the fibrous filter pads. Damp filter pads decrease the efficiency of the filter because of strength lost in the electrostatic field due to electrical arcing across the pads which is enhanced by the presence of moisture.

A further advantage of a charging element in accordance with the invention is the fact that odours are absorbed by the charging element instead of being trapped among the fibers of a filter pad. The prior art electrostatic filters referred to above partially remove certain odours, such as cigarette smoke, from filtered air. However, those odours tend to escape from the filter whenever the electrostatic charge of the filter is interrupted. Thus, a known filter which is exposed to the smoke of several cigarettes exudes an unpleasant odour whenever the electrostatic charge on the filter is lost. A filter in accordance with the invention, however, does not exude an unpleasant odour on loss of the electrostatic charge on the filter. This is a particular advantage for desktop air filters or filters installed in confined spaces such as elevators or automobiles.

It is an object of the present invention to provide an electrostatic air filter which removes odours and gases as well as particulates from filtered air.

SUMMARY OF THE INVENTION

The present invention provides a charging element for electrostatic air filters of the charged media type which serves the dual function of providing a charging element for use in such filters and removing odours and gases from air filtered by such filters. The electrostatic charging element of the invention is preferably constructed from an open celled plastic foam structure impregnated with a fine particle charcoal. When properly constructed, such a charging element is an excellent conductor of electricity and an efficient absorber of air borne odours and gases.

In more general terms, the present invention provides a charging element for an electrostatic air filter of the charged media type comprising an electrically conductive, air pervious structure for passage therethrough of air to be filtered, and an odour and gas absorbing agent integral with the structure for absorbing odours and gases borne by the filtered air.

DESCRIPTION OF THE DRAWINGS

The present invention will now be explained by way of example only and with reference to the following drawings wherein.

DETAILED DESCRIPTION OF THE INVENTION

Figure 1:
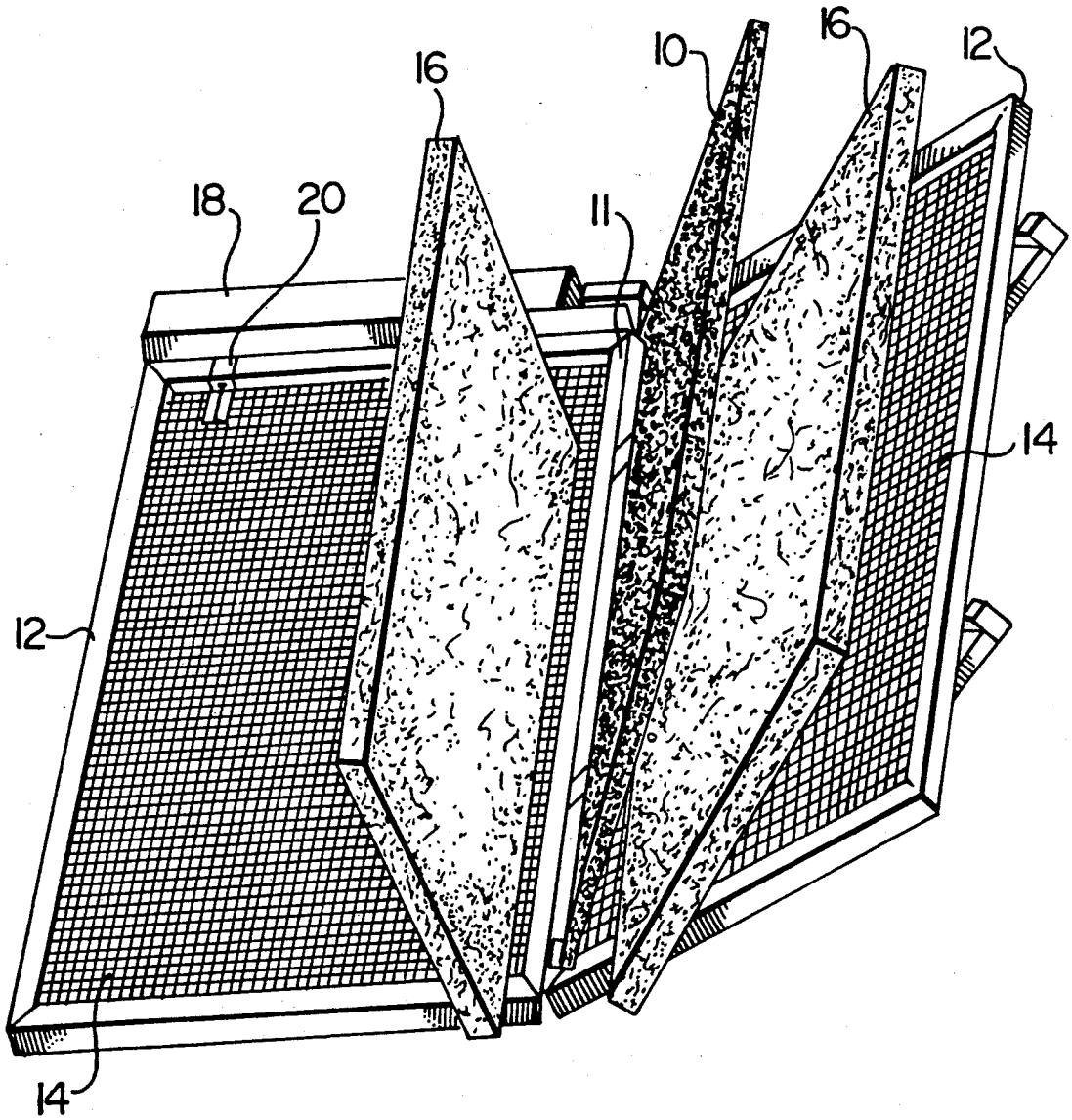
FIG. 1 is a perspective view of a known electrostatic air filter of the charged media type equipped with an electrostatic charging element in accordance with the invention.

As shown in FIG. 1, a traditional style electrostatic air filter of the charged media type is provided with an electrostatic charging element 10 in accordance with the invention. The charging element 10, as with all charging elements in accordance with the invention hereinafter referred to in relation to the drawings, is preferably an open celled plastic foam impregnated with a fine particle charcoal. One commerically available product of this type is Polysorb* currently manufactured by Columbus Metals Company.

The air filter shown in FIG. 1 includes a two part outer frame 12 which is hinged along one longitudinal edge, a pair of outer charging screens 14, a pair of dielectric filter pads 16 disposed between the central charging element 10 and the outer charging screens 14, a power supply 18 which converts low voltage, low amperage current to high voltage (6,000 volts), low amperage current for electrifying the charging element 10 via an electrode 20. The charging element 10 must be periodically replaced as it eventually becomes clogged with filtrates. In order to accommodate the replacement of the charging element 10, a plastic channel 11 hinged to the frame member 12 frictionally engages the inner edge of the charging element 10, permitting it to be slidably removed for replacement.

Figure 2:
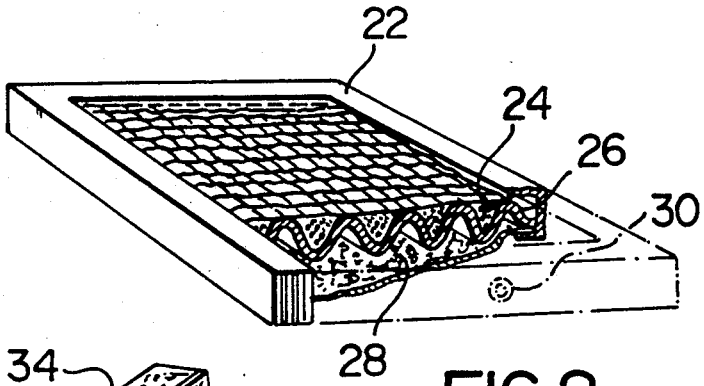
FIG. 2 is a partially cut away perspective view of a disposable air filter cartridge having a corrugated fiberglass filter and an electrostatic charging element in accordance with the invention.
Figure 3:
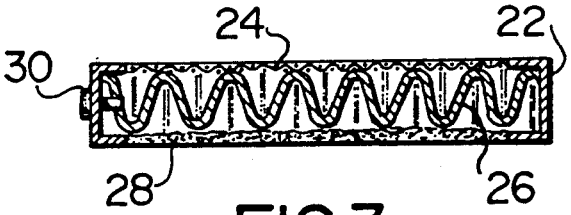
FIG. 3 is a cross sectional view of the disposable cartridge of FIG. 2.

FIGS. 2 and 3 illustrate a disposable air filter cartridge provided with a charging element in accordance with the invention. The cartridge is constructed having an outer frame 22, a charging screen 24, a corrugated fiberglass filter pad 26 and an odour and gas absorbing charging element 28. The cartridge is powered via an electrode 30 having a negative pole connected to one charging element and a positive pole connected to the other element.

Figure 4:
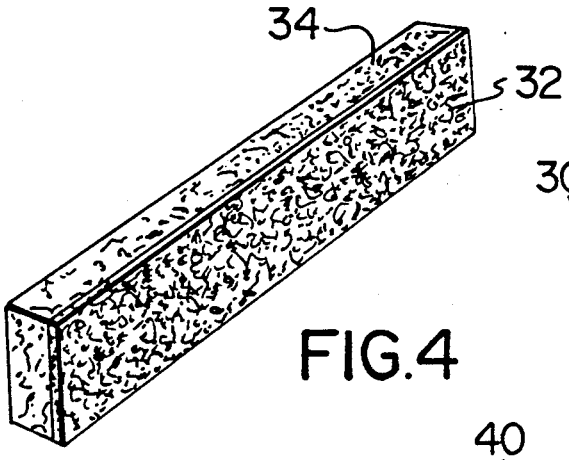
FIG. 4 is an alternate embodiment of a disposable cartridge equipped with an electrostatic charging element in accordance with the invention.

The simplest of disposable air filter cartridges is shown in FIG. 4. This air filter cartridge comprises an odour and gas absorbing charging element 32 and a dielectric filter pad 34. The use of this disposable cartridge will be described below in more detail.

Figure 5:
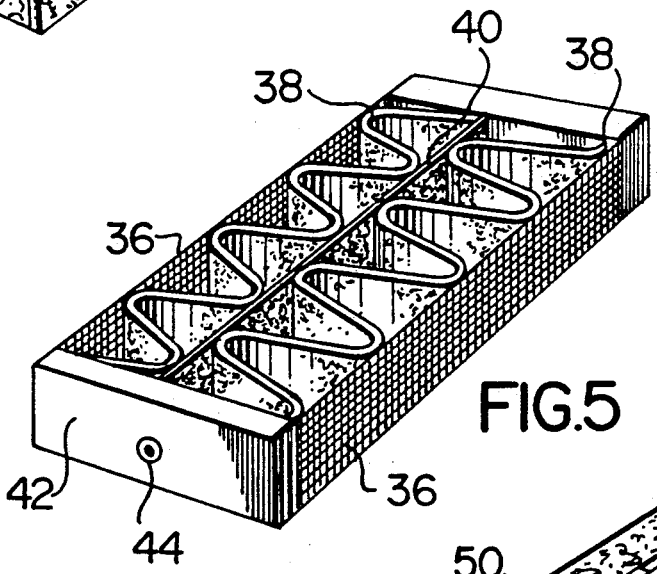
FIG. 5 is a disposable air filter cartridge having two corrugated fiberglass filter pads and an electrostatic charging element in accordance with the invention.

FIG. 5 illustrates a cartridge comprising a pair of outer charging screens 36, a pair of corrugated fiberglass filter pads 38 and an odour and gas absorbing charging element 40. Each of these components is held in the illustrated configuration by a pair of end caps 42, preferably constructed of cardboard or a nonconductive material. An electrode 44 serves for charging the disposable cartridge in a manner to be described below.

Figure 6:
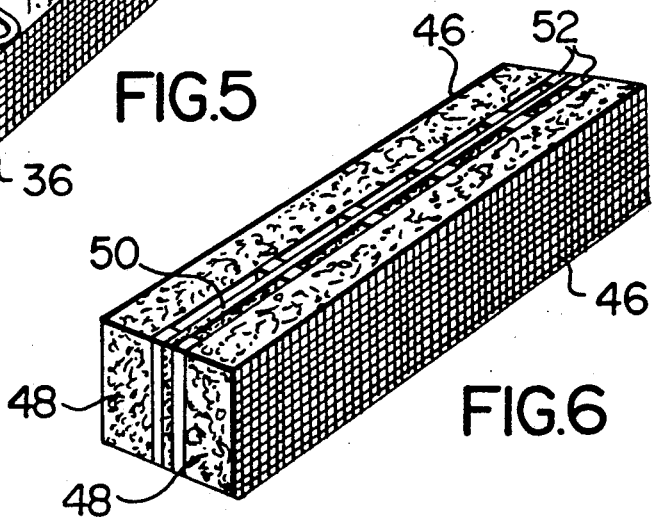
FIG. 6 is an alternate disposable cartridge having an electrostatic charging element in accordance with the invention.

FIG. 6 illustrates a further variation of a disposable air filter cartridge in accordance with the invention. This embodiment includes a pair of outer charging screens 46, a pair of dielectric fibrous filter pads 48, and an inner odour and gas absorbing charging element 50 which is separated from the dielectric filter pads 48 by opposing pairs of nonconductive spacers 52. Spacers 52 enhance the operation of the filter by preventing electrical discharge or leakage across the fibrous filter pads.

Figure 7:
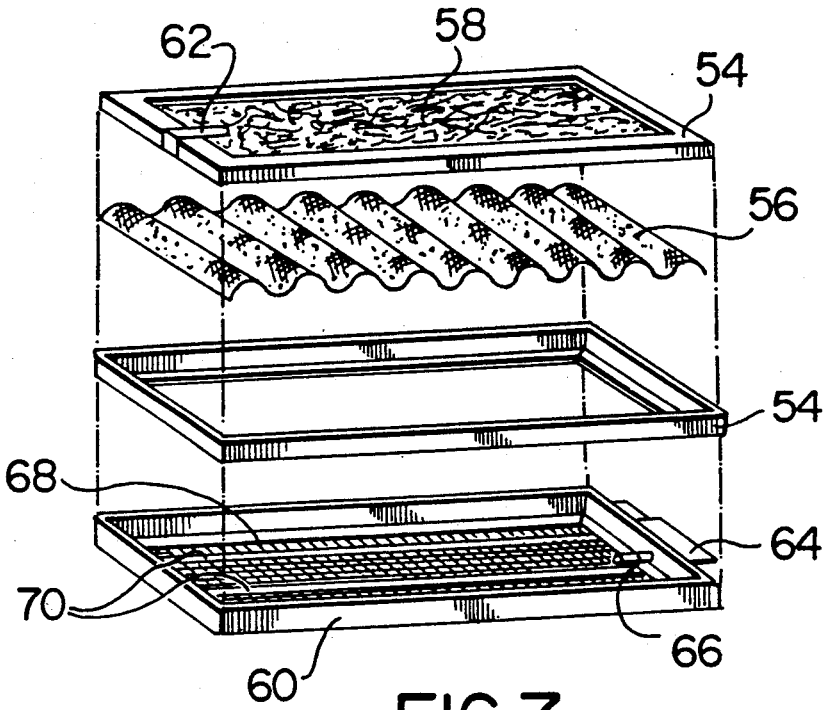
FIG. 7 is a perspective view of a filter frame suitable for use with the filter cartridges of FIGS. 2, 3 and 4.

FIG. 7 illustrates the construction of a disposable filter cartridge and other filter frame adapted to support the cartridge. The cartridge includes outer frames 54 constructed of cardboard or a nonconductive material. A corrugated fiberglass filter pad 56 is surrounded and supported by the frame. An odour and gas absorbing charging element 58 serves as the grounded charging element. The charging element 58 is electrically connected with the grounded metallic filter support frame 60 by means of a metallic foil electrode strip 62. The filter frame contains a power converter 64 which supplies high voltage power through an insulated electrode 66 to a high voltage charging screen 68. Contact between the disposable cartridge and the high voltage screen is prevented by narrow spacers strips 70 which are nonconductive. The disposable filter cartridge illustrated in FIG. 4 is also suitable for use with this filter frame. The edges of the charging element 32 (see FIG. 4) are sized to contact at least two opposing edges of grounded outside frame 70, thereby completing the electrostatic charging circuit.

Figure 8:
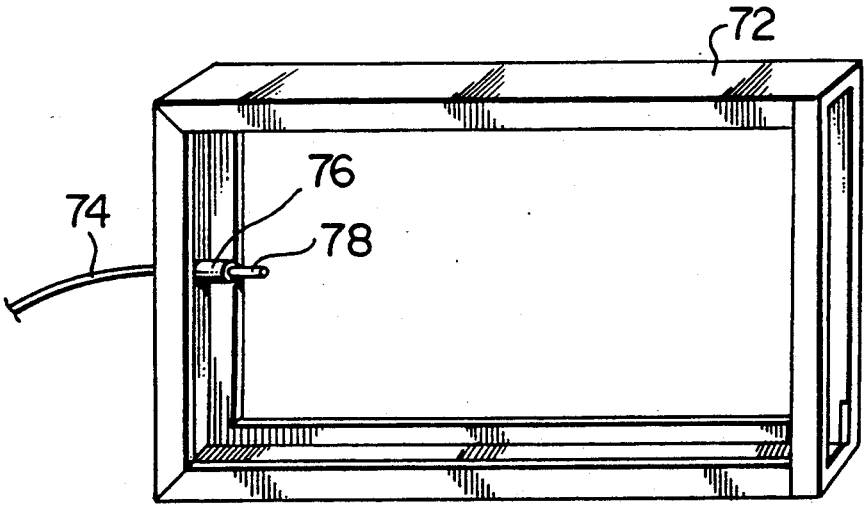
FIG. 8 is a perspective view of a filter frame suitable for use with the filter cartridges of FIGS. 5 and 6.

FIG. 8 illustrates a disposable cartridge support frame suitable for use with the disposable cartridges illustrated in FIGS. 2, 5 and 6. This air filter cartridge support frame includes an outer frame 72 having an open end for receiving a disposable air filter cartridge. The opposite end of the support frame is provided with a high voltage supply cable 74 and an electrode having a negative pole 76 and a positive pole 78. The poles 76 and 78 mate with the corresponding poles of electrodes 30 (see FIG. 2) and 44 (see FIG. 5), for supplying an air filter cartridge with electrical energy.

Figure 9:
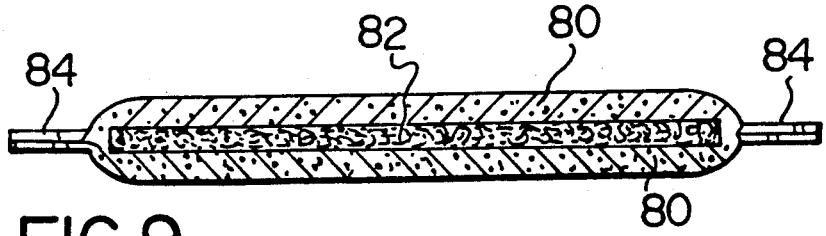
FIG. 9 illustrates an alternate embodiment of a disposable filter cartridge provided with an electrostatic charging element in accordance with the invention.
Figure 10:
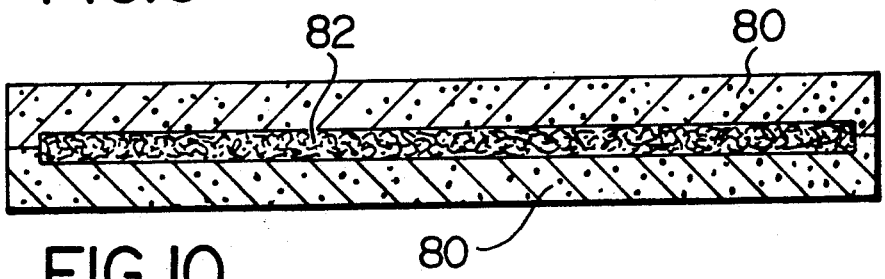
FIG. 10 illustrates a variation of the disposable cartridge of FIG. 9.

FIGS. 9 and 10 disclose two further embodiments of disposable cartridges provided with charging elements in accordance with the invention. Each embodiment includes a pair of outer dielectric fibrous filter pads 80 and an odour and gas absorbing charging element 82. In FIG. 9, the charging element 82 is held in position 84 by an outer lip portion of the disposable cartridge formed by compressing the fibrous filter pads 80 together and securing them in a compressed state with glue, stitching or tape. In the embodiment shown in FIG. 10, the dielectric fibrour filter pads 80 are adhered directly to the charging media 82 with any suitable adhesive which does not inhibit the passage of air through the cartridge.

Figure 11:
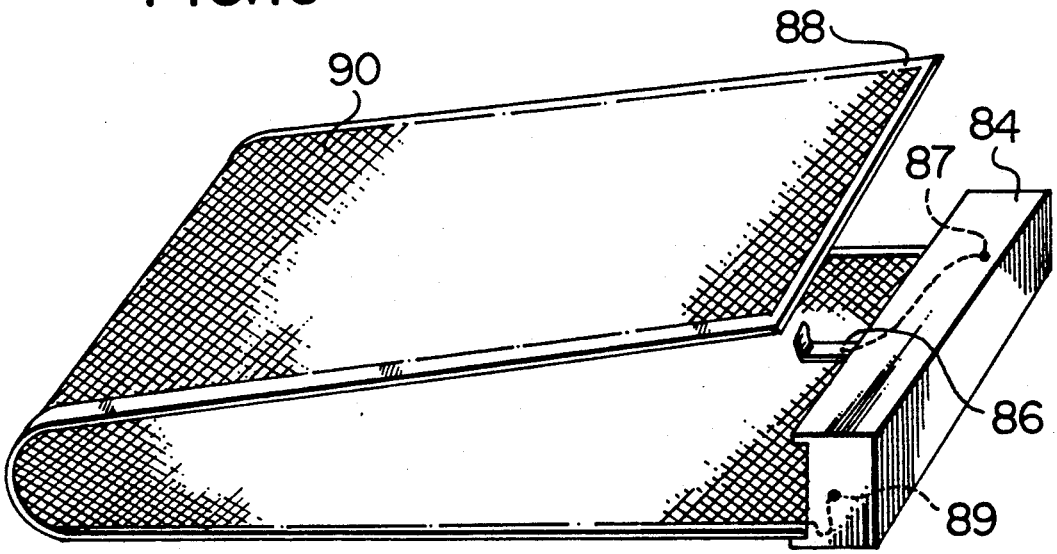
FIG. 11 illustrates a filter cartridge frame suitable for use with the disposable cartridge of FIG. 9.

FIG. 11 shows a cartridge filter frame suitable for use with the disposable cartridge filter of FIG. 9. The frame includes a power converter 84, a charging electrode 86, an outer flexible frame 88 and an outer charging screen 90. The disposable cartridge of FIG. 9 is placed inside the frame of FIG. 11 and, on closing the frame, the upturned point of electrode 86 is driven through the bottom filter pad 80 and into contact with the charging element 82.

Figure 12:
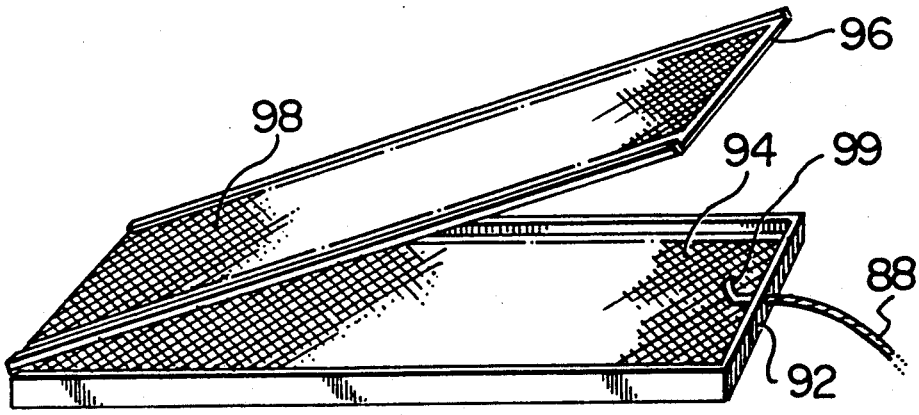
FIG. 12 illustrates a filter cartridge frame suitable for use with the disposable filter cartridge of FIG. 10.

FIG. 12 illustrates a filter frame suitable for use with the disposable cartridge of FIG. 10. The frame includes a high voltage power supply cable 88, a charging electrode 90, a bottom support tray 92 having a bottom charging screen 94 and a top support frame 96 having a top charging screen 98. Electrode 90 contacts the charging element 82 of the filter cartridge shown in FIG. 10 in the manner described above.

The disposable air filter cartridges illustrated in FIGS. 9 and 10 are also adapted for use in the filter frame of FIG. 1. When the filter cartridge of FIG. 9 is properly sized, one longitudinal edge may be inserted into the plastic channel 11, replacing the charging media 10 and both of the fibrous filter pads 16. The disposable filter cartridge of FIG. 10 may also be used in conjunction with the filter frame of FIG. 1 if the filter frame is not equipped with a plastic channel 11, permitting the cartridge to fit within the inner edges of the outer frame members 12. In this case, the filter cartridge of FIG. 10 replaces the charging element 10 and the fibrous filter pads 16 of the air filter of FIG. 1.

Those skilled in the art will recognize that the various electrostatic air filters heretofore described are exemplary only. A charging element in accordance with the invention may be employed in the construction of a variety of electrostatic air filters of the charged media type.

Each embodiment heretofore described functions in essentially the same fashion. A dielectric fibrous filter pad is sandwiched between a pair of charging elements and the fibres of the pad are polarized by an electrostatic field generated between the charging elements when the filter is electrically energized. In the embodiments disclosed in FIGS. 1, 11 and 12 which have outside charging elements that are a part of the air filter support frame, it is preferable that those charging elements be constructed from a metallic mesh or screen which is easily cleaned and serviceable for an extended period of time.

In the disposable cartridges disclosed in FIGS. 5 and 6, any of the three charging elements 36 and 40 (see FIG. 5) or 46 and 50 (see FIG. 6) may be a charging element in accordance with the invention. For a particularly efficient filter, all three charging elements may be an odour and gas absorbing element in accordance with the invention. For reasons of economy of construction, only one odour absorbing charging element is illustrated in each disposable cartridge, however, more than one may be used in a single cartridge to improve the efficiency of odour and gas absorption by the disposable cartridge. The position of the odour and gas absorbing charging element within the filter structure is, aside from design considerations, of no consequence. An odour and gas absorbing charging element may serve as either a negatively or positively charged element and functions equally well regardless of its charge.

Although the charging elements disclosed heretofore are charcoal filled foam structures, other binding agents may be used to construct a planar or shaped air pervious structure that would be an equally efficient charging element. Other odour and gas absorbing agents may also be substituted for charcoal, e.g. sodium bicarbonate or calcium carbonate to name two commonly available agents, provided that an electrical conductor, graphite fibres for example, is incorporated into the binding mixture to provide electrical conductivity if a nonconductive odour and gas absorbing agent is used.

Changes and modifications in the specifically described embodiments can be carried out without departing from the scope of the invention which is intended to be limited only by the scope of the appended claims.

The embodiments of the invention in which an exclusive property or privilege is claimed are defined as follows:

1. In an electrostatic air filtration system of the charged media type, an air filter, comprising:

at least two electrostatic charging elements in opposed spaced-apart relation;

a fibrous filter pad disposed between said charging elements for removing particulate matter;

a frame for supporting said charging elements and said fibrous filter pad in an air path of an air handling system; and a high voltage power source having a positive pole and a negative pole for charging said charging elements;

wherein at least one of the charging elements is an air permeable plastic foam structure which permits the passage therethrough of air to be filtered, said structure being impregnated with an electrically conductive, odor and gas adsorbing agent sufficient to render said plastic foam electrically conductive; and an electrode of said high voltage power source being in contact with the conductive plastic foam to electrically charge the plastic foam charging element.

2. In an electrostatic air filtration system of the charged media type, an filter for removing odors and gasses and particulate matter from air passing therethrough, said filter comprising:

a high voltage power supply having first and second terminals;

at least two opposed charging elements, at least a first one of said charging elements being electrically connected to the first terminal of said power supply and at least a second one of said charging elements being electrically connected to the second terminal of said power supply, at least one of said charging elements being an air permeable plastic foam structure for the passage therethrough of air to be filtered, said plastic foam structure being impregnated with an electrically conductive, odor and gas adsorbing, non-metallic agent sufficient to render said plastic foam electrically conductive such that contact between a terminal of said power supply and the conductive plastic foam charging element electrically charges the conductive plastic foam charging element;

a dielectric, fibrous filter pad disposed between each two opposed charging elements; and a frame for supporting said charging elements and said fibrous filter pads in an air handling system.

3. In an electrostatic air filtration system of the charged media type, an air filter comprising:

a disposable air filter cartridge comprising at least one dielectric fibrous filter pad for removing particulate matter from air passing therethrough; and a charging element adjacent each side of said fibrous filter pad, at least one of said charging elements being an air permeable, plastic foam structure impregnated with an electrically conductive, odor and gas adsorbing non-metallic agent sufficient to render said structure electrically conductive;

a frame for retaining said filter cartridge in position for removing gases and odors and particulate matter from air moving through the air filter, said frame including means for permitting insertion and removal of said cartridge into and out of the frame; and a high voltage power supply having terminals respectively electrically connected to said charging elements of said filter cartridge, whereby contact between the terminals and the respective charging elements electrically charges said charging elements.

4. The air filter of claim 3, wherein said non-metallic agent is fine particle charcoal.

5. The air filter of claim 3, wherein said foam structure is formed of an open-celled plastic foam.

6. The air filter of claim 3, wherein said cartridge is formed by adhesively or frictionally attaching the filter pad to the conductive foam charging element.

7. The air filter of claim 3, wherein said frame is formed of an electrically insulating material.

8. The air filter of claim 3, wherein said frame surrounds and supports said cartridge.

9. The air filter of claim 3, further including non-conductive spacers disposed between the filter pad and at least one charging element of each two charging elements.

10. The air filter of claim 3, wherein said fibrous filter pad is formed with a corrugated configuration.

11. The air filter of claim 3, wherein said frame contains a slot at one end for removing and replacing the cartridge.

12. The air filter of claim 3, wherein in said cartridge one of said charging elements is sandwiched between two filter pads, each of said filter pads having a peripheral lip portion for sealing said one charging element therebetween, said cartridge being adapted for insertion into the frame, and said frame including the other of said charging elements.

13. The air filter of claim 3, wherein said cartridge further comprises a second filter pad, and said filter pads are adhered to opposite sides of said one charging element of conductive foam, said cartridge being insertable into said frame, and said frame including a charging screen which serves as the other of said charging elements.

14. The air filter of claim 3, wherein said cartridge further comprises a second filter pad positioned between the charging elements; and a third charging element positioned between the filter pads.

15. The air filter of claim 14, further including a non-conductive spacer between each of the filter pads and said third charging element.

* * * * *